US009192871B2

(12) United States Patent
Henrik

(10) Patent No.: US 9,192,871 B2
(45) Date of Patent: Nov. 24, 2015

(54) LIGHTING/SOUNDING DEVICE ACTIVATED BY INFLATION OF BALLOON

(75) Inventor: Bo Stieler Henrik, Shenzhen (CN)

(73) Assignee: Shenzhen Promotion Concept Co. LTD., Shenzhen, Guangdong (CN)

( * ) Notice: Subject to any disclaimer, the term of this patent is extended or adjusted under 35 U.S.C. 154(b) by 0 days.

(21) Appl. No.: 14/355,207

(22) PCT Filed: Jan. 4, 2012

(86) PCT No.: PCT/CN2012/070042

§ 371 (c)(1),
(2), (4) Date: Apr. 29, 2014

(87) PCT Pub. No.: WO2013/063869

PCT Pub. Date: May 10, 2013

(65) Prior Publication Data

US 2014/0295732 A1 Oct. 2, 2014

(30) Foreign Application Priority Data

Oct. 31, 2011 (CN) ..... 2011 1 0337121

(51) Int. Cl.
*A63H 27/10* (2006.01)
*F21V 3/02* (2006.01)

(52) U.S. Cl.
CPC ..... *A63H 27/10* (2013.01); *F21V 3/026* (2013.01); *A63H 2027/1033* (2013.01); *A63H 2027/1058* (2013.01)

(58) Field of Classification Search
CPC ..... A63H 2027/1058
USPC ..... 446/485, 220, 224, 176, 175, 219, 213, 446/397
See application file for complete search history.

(56) References Cited

U.S. PATENT DOCUMENTS

2005/0269442 A1* 12/2005 Nguyen et al. ..... 244/31
2012/0129420 A1* 5/2012 Wu ..... 446/220

FOREIGN PATENT DOCUMENTS

EP 1600690 A1 * 11/2005

* cited by examiner

*Primary Examiner* — Gene Kim
*Assistant Examiner* — Rayshun K Peng

(57) ABSTRACT

A lighting/sounding device activated by inflation of a balloon includes a lighting lamp/sounder, a battery, and a housing at least covering the lighting lamp/sounder. The housing includes an inlet end, an outlet end, and an air channel connecting the inlet end and the outlet end to form a through passage for air flow within the housing. The lighting lamp/sounder is provided within the air channel and has a sealing device for sealing off the air channel. When the balloon is not inflated, the lighting lamp/sounder cannot be activated; after the balloon is inflated, a pressure difference generated between inside and outside the balloon pushes the lighting lamp/sounder towards the outer end of the air channel and seals the air channel; and, when the air channel is sealed up, an electric circuit of the lighting lamp/sounder is closed and the lighting lamp/sounder is activated to operate.

1 Claim, 8 Drawing Sheets

LIGHTING/SOUNDING DEVICE ACTIVATED BY INFLATION OF BALLOON

CROSS REFERENCE OF RELATED APPLICATION

This is a U.S. National Stage under 35 U.S.C 371 of the International Application PCT/CN2012/070042, filed Jan. 4, 2012, which claims priority under 35 U.S.C. 119(a-d) to CN 201110337121.1, filed Oct. 31, 2011.

BACKGROUND OF THE PRESENT INVENTION

1. Field of Invention

The present invention relates to an accessory of a balloon, particularly to a lighting/sounding device for a balloon that operates when the balloon is inflated.

2. Description of Related Arts

Balloons are decorations frequently used in daily life, and people most usually decorate the environment with inflated balloons.

However, the usage is too monotonous to meet diversified needs. So balloons with various special effects have been created, such as luminous balloons, lighting balloon and sounding balloons. Chinese patent application CN200610122541.7, for one, discloses a luminous balloon, which has a lighting effect and is characterized in that an LED lamp is taken as a light source and a light circuit device which supplies power to a silicon photocell is arranged in a plastic shell with an air hole. The luminous balloon has a simple frame, and is convenient to use and suitable not only for being held in hand after being sleeve jointed with a plastic pipe but also for being tied and dragged by a rope to float in the air or ornament the night scene. U.S. Pat. No. 7,344,267 discloses an illuminated toy balloon having an illuminating device and a cylindrical plug with an integrally-formed radially extending integral flange insertable within the balloon neck, wherein the illuminating device is provided within the balloon neck.

Since balloons are usually made of latex, aluminum film or plastic, how to install a lighting/sounding device becomes an important issue for a lighting/sounding balloon. As for the patent U.S. Pat. No. 7,344,267, a lighting device is installed at the neck of the balloon intake nozzle, which would affect inflation and use of the balloon and hence is not convenient enough. Then people think of a way to install a lighting/sounding device inside a balloon by fixing the device onto the balloon wall, such as the structure disclosed by the patent application GB20070004575 wherein a lighting device is fixed onto the inner wall of a balloon, but such a structure has a problem on how to control the lighting/sounding device inside the balloon.

Therefore, a seal sticker described in the patent application WO20110210 has become a key mechanism to control a lighting/sounding device inside a balloon. The disclosed seal sticker is used to disconnect the electric circuit of the lighting device, and the circuit is connected once the seal sticker is withdrawn, thereby controlling a lighting/sounding device to start. However, the seal sticker is not easy to process and install as the seal sticker needs to be inserted into the circuit of the lighting/sounding device, which increases difficulty and cost of processing, and withdrawal and then disposal of the seal sticker are especially a waste of resources and environmentally unfriendly.

SUMMARY OF THE PRESENT INVENTION

On the basis of the above problems, the present invention aims to provide a lighting/sounding device activated by inflation of a balloon, which facilitates control of the lighting/sounding device without affecting normal use and inflation of the balloon.

Another object of the present invention is to provide a lighting/sounding device activated by inflation of a balloon, which is easy to control, has a simple and practical structure, turns on and off the lighting/sounding device by taking full advantage of the principle of pressure, and conserves resources producing no environmentally unfriendly wastes.

To achieve the above objects, the present invention is carried out through the following technical solutions.

A lighting/sounding device activated by inflation of a balloon comprises a lighting lamp/sounder, a battery, and a housing at least covering the lighting lamp/sounder, wherein the housing comprises:

an inlet end to let air or other gases into the housing, an outlet end to discharge the air or the other gases from the housing, and an air channel to connect the inlet end and the outlet end so that a through passage for air flow is formed within the housing;

wherein the lighting lamp/sounder is provided in the air channel and has a sealing device for sealing off the air channel.

Before inflation of the balloon, a circuit of the lighting lamp/sounder is disconnected and the lighting lamp/sounder cannot be activated to operate; after the balloon is inflated, a gas pressure is generated within and forms a pressure difference between inside and outside the air channel, which pushes the lighting lamp/sounder towards the outer end of the air channel and seals the air channel; and, when the air channel is sealed up, the electric circuit of the lighting lamp/sounder is connected and the lighting lamp/sounder is activated to operate.

The sealing device is any one selected from the group consisting of an O-ring, a seal ring, and a seal coil (like a rubber ring), or a fitted mechanism formed between the lighting lamp/sounder and the housing. Such mechanisms as a tightly fitted or nested mechanism between the outside surface of the lighting lamp/sounder and the housing or a buckled mechanism between the lighting lamp/sounder and the housing are all able to seal off the air channel and thus can be referred to as a form of a sealing device.

The lighting lamp/sounder has a supporting and fixing holder that covers the lighting lamp/sounder at least from one cross section so that the lighting lamp/sounder has an outer wall at the cross section.

The outer wall is sleeved with a sealing device in a ring-shaped structure, and is located within the air channel.

In correspondence with the sealing device, at least a part of the air channel is cylindrical so as to seal off the air channel with the sealing device and connect the circuit of the lighting lamp/sounder.

In a preferred embodiment, the lighting lamp/sounder is provided at the outside with a seal coil or seal ring projecting from an exterior margin of the lighting lamp/sounder for close contact with the air channel to seal the air channel up.

The seal coil or seal ring projecting from the exterior margin of the lighting lamp/sounder has a same sealing function as the sealing device provided on an external surface.

The housing has a cross section in a shape of T, I, or trapezoid, so that the air channel forms a reduced neck portion around which a platform is provided; and a seal gasket is provided at one end of the lighting lamp/sounder, which projects from the end of the lighting lamp/sounder with a flat contact surface and has a diameter larger than a diameter of the reduced neck portion so that the contact surface is able to form a sealing contact with the platform, thereby sealing off the air channel.

The inner wall of the housing has a bell-like structure, the lighting lamp/sounder sleeved with the seal coil or seal ring is located inside the bell, and a clearance between the lighting lamp/sounder and the housing constitutes the air channel.

The lighting/sounding device is provided inside a balloon and is fixed onto an inner wall of the balloon by an external cover with an exhaust port connecting the outlet end of the lighting/sounding device to form the air channel.

Further, a piercing device is provided where the lighting/sounding device contacts the inner wall of the balloon inside the external cover, which has a pointed tip to pierce the inner wall of the balloon when the external cover is fixed onto the lighting/sounding device.

The inlet end has a top ring with a hollow middle part and a projecting top protrusion fixed onto the top ring via two side walls. The lighting lamp/sounder is held by the top ring to move so as to expose the air channel for discharging air.

The lighting lamp/sounder is elastically provided within the air channel and is supported by an elastic mechanism fixed inside the air channel and electrically conductive to close a control circuit of the lighting lamp/sounder. The elastic mechanism usually applies a metal spring or a metal spring plate.

The housing of the lighting/sounding device has an extending portion at the inlet end, which extends outwards for people to blow air into the balloon.

The lighting/sounding device is able to be installed at, tied to, or fixed onto a balloon nozzle; the lighting device is also able to be installed at any position other than the balloon nozzle and be fixed onto the balloon wall, either way is able to implement the present invention. The balloon and the lighting/sounding device is able to be bound together with an O-ring, a rope or a rubber ring; or the balloon is able to be pressed onto the lighting/sounding device by hydraulic pressure; or the balloon is able to be fixed onto the lighting/sounding device by adhesives.

A structure implementing the present invention uses an inner pressure of the balloon to start the lighting lamp/sounder, which makes the control of the lighting lamp/sounder easier and more liable.

Besides, the present invention allows provision of the lighting lamp/sounder either inside the balloon or at the balloon nozzle, which makes the lighting lamp/sounder easier to use; and since no additional control mechanism is needed, the present invention does not produce pollutive waste and is more environmental friendly and energy conservative.

DETAILED DESCRIPTION OF THE PREFERRED EMBODIMENT

To explain the objects, technical solutions and advantages of the present invention in a clearer way, here is a detailed description with reference to the drawings and the embodiment. It is to be understood that any embodiment described herein is intended to be illustrative, without any limitation to the present invention.

Figure 1:
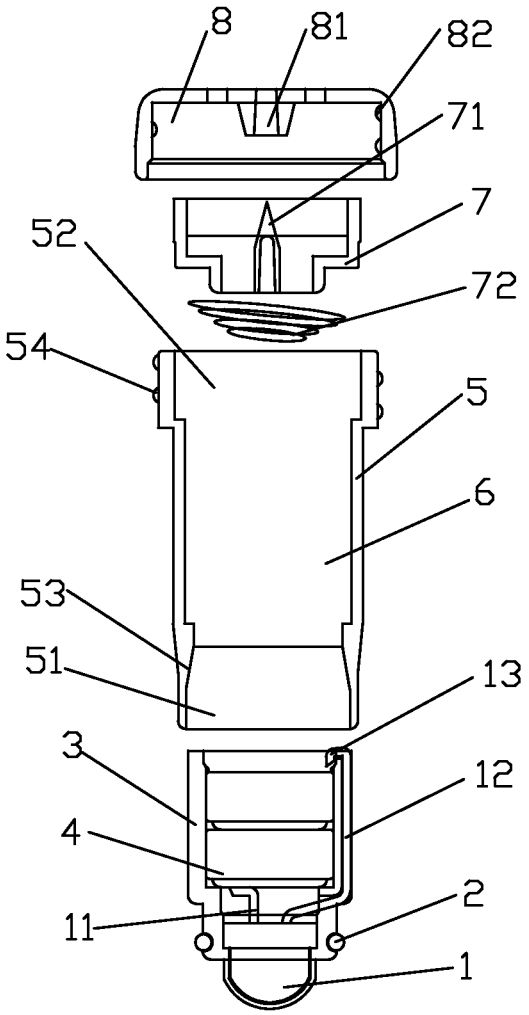
FIG. 1 is an exploded diagram of the first embodiment of the presented invention.

FIG. 1 shows the first embodiment of the present invention, which is a lighting device and mainly comprises, as shown, an LED lamp 1, a holder 3, button batteries 4 and a housing 5.

In the embodiment, two contact pieces extend from a back end of the LED lamp 1, wherein a first contact piece 11 is directly connected between the LED lamp 1 and the button batteries 4; and a second contact piece 12 bends outwards, extends along an outer wall of the holder 3 to a back of the button batteries 4, and then bends inwards to form a bent portion 13 that is directed at the back of the button batteries 4 and is able to be connected to the button batteries 4 via a spring coil 72 so as to close an electric circuit and illuminate the LED lamp 1.

The button batteries 4 normally number 1 to 4 (the drawings show two batteries in a way not limiting the number thereof in other implementations), which are provided along with the LED lamp 1 inside the holder 3 and are fixedly supported by the holder 3. The holder 3 is sleeved with the hollow housing 5 with an inlet 51 at one end and an outlet 52 at the other end, and a clearance between the housing 5 and the holder 3 constitutes an air channel 6. An inwardly inclined wall 53 is provided at an inner side of the inlet 51 while a ring-shaped seal coil 2 is fixed onto an outer wall of the holder 3, and the seal coil 2 projects from the outer wall of the holder and is able to be clamped onto the inclined wall 53 more and more tightly to seal the air channel 6.

To fix the lighting device onto a balloon wall, the housing 5 is fitted to an external cover 8 to get fixed. To be specific, the housing 5 has a projecting external thread 54 in an outer wall of a trailing end while the external cover 8 has an internal thread 82 in an inner wall, the external thread 54 engages with the internal thread 82 to fix the housing 5 with the external cover 8, and furthermore, the balloon wall passes between the housing 5 and the external cover 8 so that the two are fixed thereto. (The internal thread 82 and the external thread 54 may have the same function in a way of indentation.)

In respect that the air channel 6 needs an exhaust passage, the balloon wall has to be pierced after the external cover 8 fixes the balloon wall and the housing 5 together, so an exhaust port 81 is provided at a center of the external cover 8 and a piercing cover 7 is further provided between the external cover 8 and the housing 5, which is a ring-shaped cover (the piercing cover is not necessarily ring-shaped as long as the piercing cover is able to pierce the balloon wall) and has a projecting spike 71 directed at the exhaust port 81 at the center. When the external cover 8 fixes the balloon wall and the housing 5 together, a middle part of the external cover 8 will be concaved if the external cover 8 is pressed hard, and the spike 71 will protrude into the exhaust port 81 to pierce the balloon wall so as to form the exhaust passage.

The piercing cover 7 is further sleeved with a spring coil 72 made of metal to contact the bent portion 13 of the contact piece 12 and the button batteries 4.

In other implementations without a piercing cover 7, the spring coil 72 is directly fixed to the housing 5 instead, and the balloon wall is pierced from outside to form an air channel.

Figure 2:
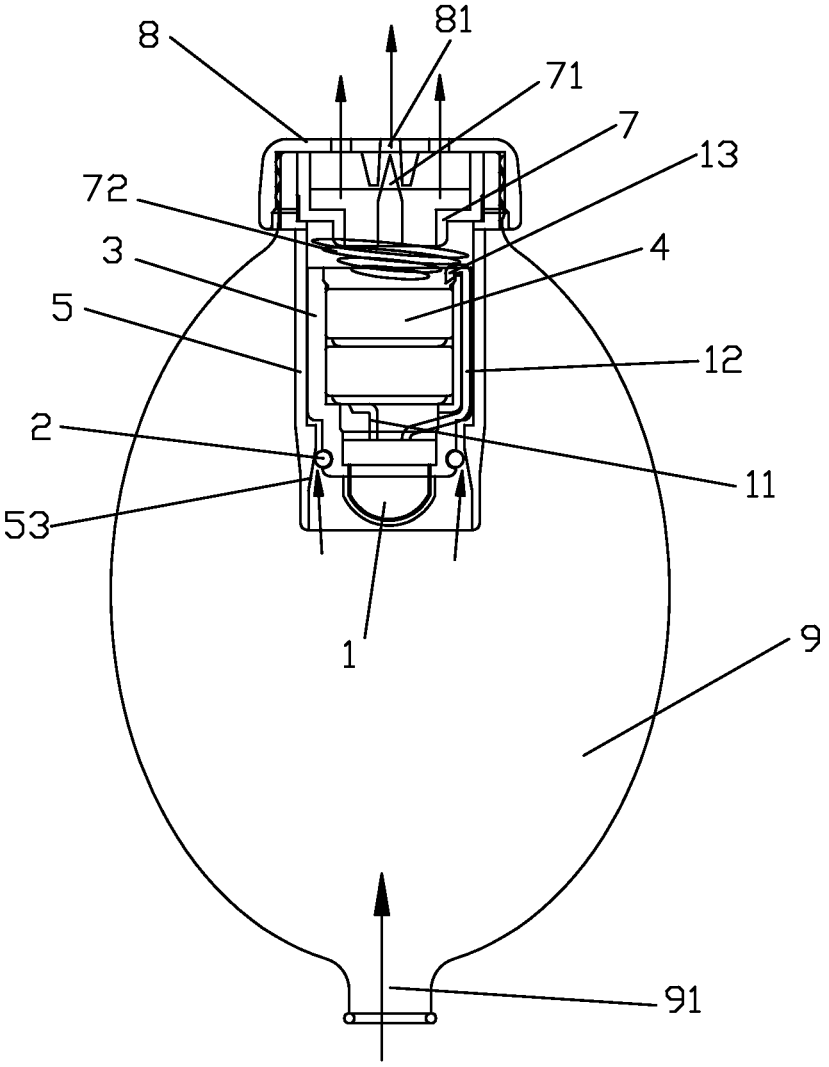
FIG. 2 is a diagram of the first embodiment during inflation.
Figure 3:
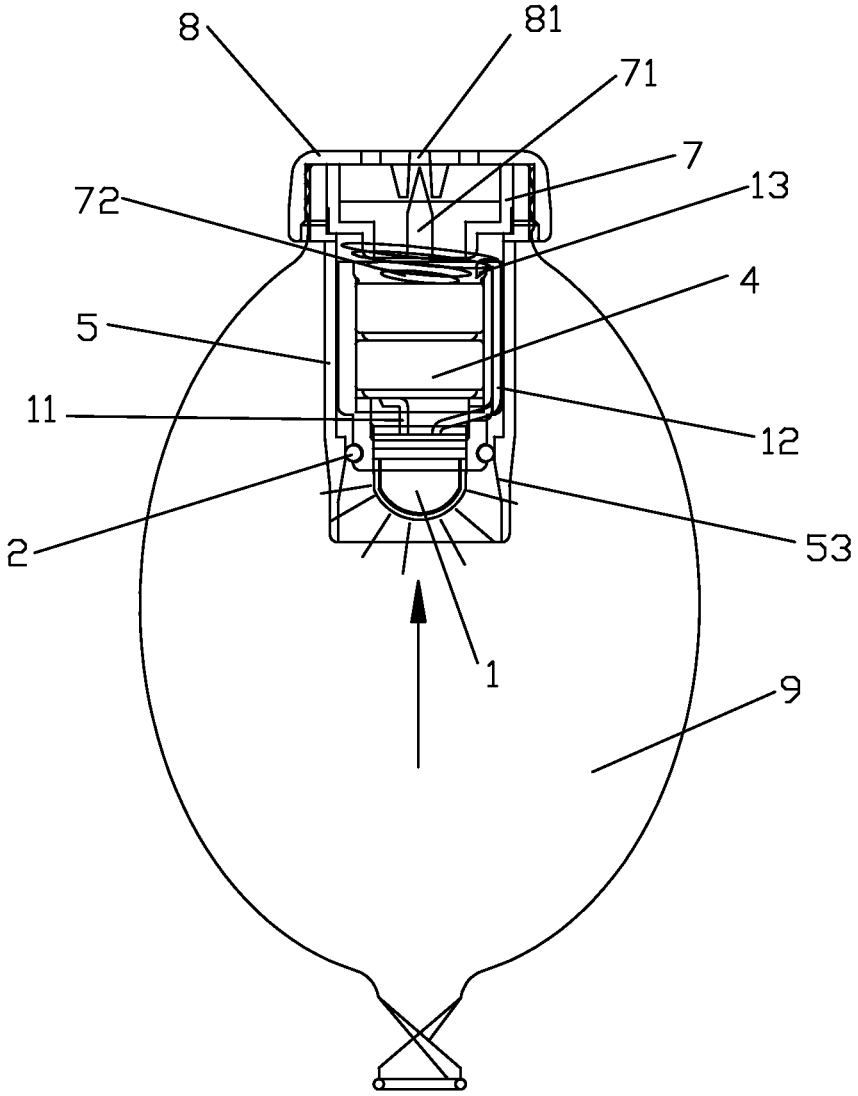
FIG. 3 is a diagram of the inflated first embodiment with an illuminated lighting lamp.

With reference to FIGS. 2 and 3, the lighting device is installed inside the balloon 9 and fixed onto the balloon wall. During inflation of the balloon 9 through a balloon nozzle 91, a pressure inside the balloon 9 is very low at beginning and a pressure difference between inside and outside the balloon is negligible, but when the inner pressure reaches a certain level, the pressure difference is large enough to discharge air through the air channel 6 in a direction of a arrow; then, the exhaust air pushes the holder 3 provided within the air channel 6 to slide outwards along the air channel 6 bringing the seal coil 2 on the holder 3 into contact with the inclined wall 53; and the air channel 6 will be sealed up to stop discharging air from the balloon 9 when the seal coil 2 comes into sealing contact with the inclined wall 53.

As the spring coil 72 is settled in the housing 5, the metal spring coil 72 gets held by the button batteries 4 when the holder 3 is sliding outwards, and the spring coil 72 gets compressed and comes into contact with both the button batteries 4 and the bent portion 13 formed by the contact piece 12 extending backwards, thereby connecting the circuit and illuminating the LED lamp 1.

When the balloon 9 is deflated, the pressure difference between inside and outside the balloon 9 disappears and the spring coil 72 gets restored freely and releases the button batteries 4 and the holder 3, and once the spring coil 72 is no longer in contact with the button batteries and the bent portion 13 formed by the contact piece 12 extending backwards, the circuit is disconnected and the LED lamp 1 is turned off.

In this way, the lighting device will be turned on under an effect of the internal pressure in the balloon and turned off once the internal pressure disappears. Such a structure achieves good results and is easy to use and control for requiring no other control mechanism.

Figure 4:
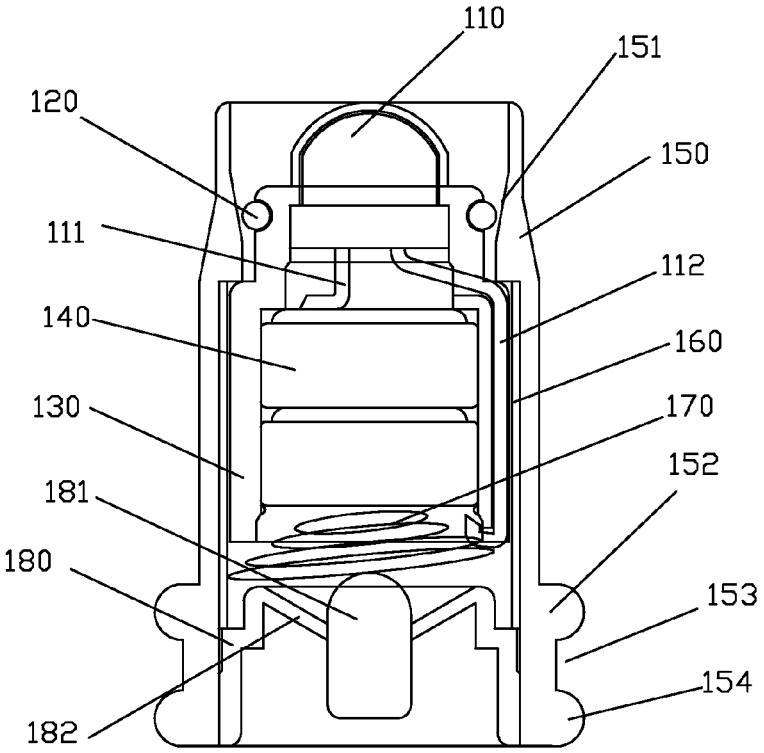
FIG. 4 is a diagram of the second embodiment of the presented invention.
Figure 5:
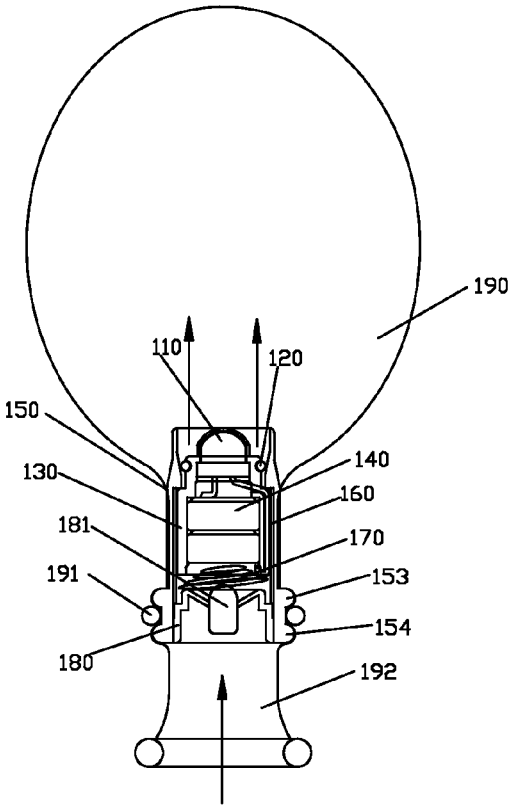
FIG. 5 is a diagram of the second embodiment during inflation.
Figure 6:
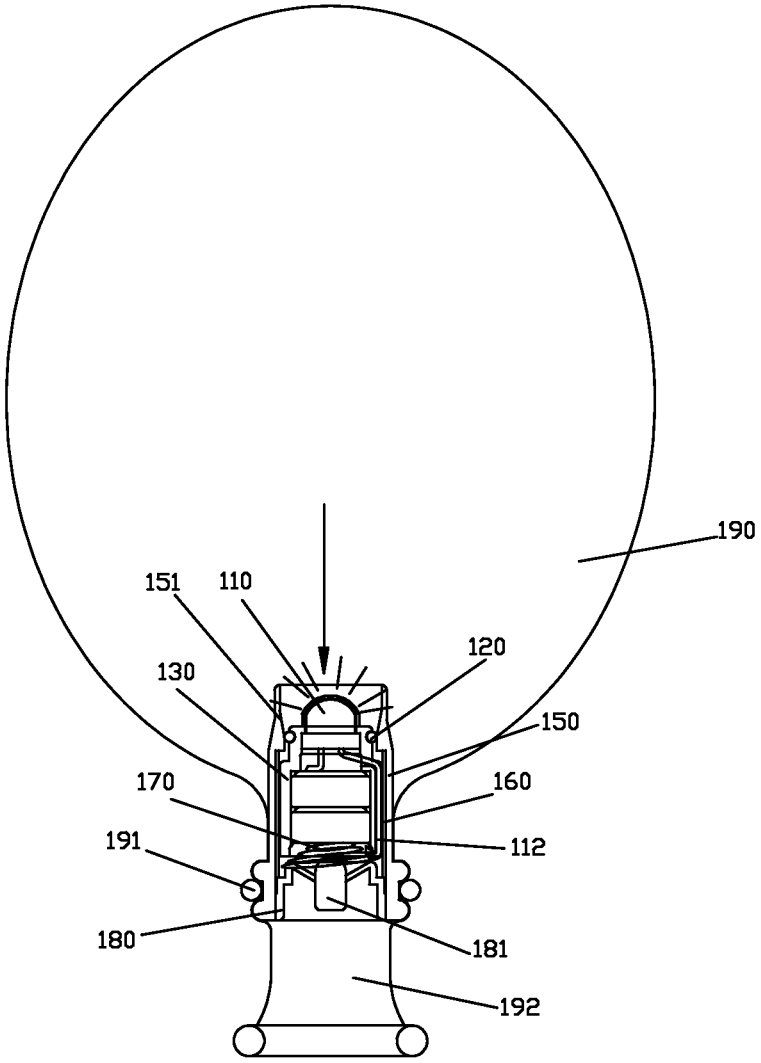
FIG. 6 is a diagram of the inflated second embodiment with an illuminated lighting lamp.

FIGS. 4-6 show the second embodiment of the present invention, which, as shown in FIG. 4, is a lighting device and mainly comprises an LED lamp 110, a holder 130, button batteries 140 and a housing 150.

Likewise, two contact pieces extend from a back end of the LED lamp 110, wherein a first contact piece 111 is directly connected between the LED lamp 110 and the button batteries 140, and a second contact piece 112 bends outwards and extends along the outer wall of the holder 130 to the back of the button batteries 140.

The button batteries 140 normally number 1 to 4 (the drawings show two batteries in a way not limiting the number thereof in other implementations), which are provided along with the LED lamp 110 inside the holder 130 and are fixedly supported by the holder 130. The holder 130 is sleeved with the hollow housing 150 with an inlet at one end and an outlet at the other end, and a clearance between the housing 150 and the holder 130 constitutes an air channel 160. An inwardly inclined wall 151 is provided at an inner side of the outlet while a ring-shaped seal coil 120 is fixed onto an outer wall of the holder 130, and the seal coil 120 projects from the outer wall of the holder 130 and is able to be clamped onto the inclined wall 151 more and more tightly to seal the air channel 160.

In this embodiment, the lighting device is usually provided at the balloon nozzle, so the housing 150 has two projections 152 and 154 at a middle part to form therebetween a ring-shaped groove 153 where an O-ring 191 for fixing the balloon and the lighting device is provided. Fixing the lighting device at the nozzle 192 of the balloon 190 makes it possible to put the lighting device of the present invention in the balloon nozzle, and thereby normal use of the balloon is not affected as the balloon is still able to be tied to a pipe or other accessories after inflation.

A metal spring coil 170 (or a metal spring plate, instead) within the air channel 160 functions as an elastic mechanism for connecting the contact piece 112 and the button batteries 140 to close the circuit. The metal spring coil 170 has a top ring 180 at the outer end, which is fixed on the inner wall of the housing 150 for positioning the metal spring coil 170. The ring-shaped top ring 180 has a top protrusion 181 projecting from the center, which is fixed to the top ring 180 via a side wall 182.

The top ring 180 is used to position the metal spring coil 170, and the top protrusion 181 is mainly used to hold the metal spring coil 170. Another function of the top protrusion 181 lies in that by pressing the top protrusion 181, the button batteries 140 and the holder 130 are held and pushed into the balloon so as to deflate the balloon.

With reference to FIGS. 5 and 6, air enters the balloon 190 in a direction of an arrow when the balloon 190 is inflated. At a beginning of inflation, the pressure inside the balloon 190 is very low and the pressure difference between inside and outside the balloon is negligible, but when the inner pressure reaches a certain level, the pressure difference is large enough to discharge air from the balloon through the air channel 160 so as to maintain pressure balance.

During discharge of the air, the exhaust air pushes the holder 130 provided within the air channel 160 to slide outwards along the air channel 160 bringing the seal coil 120 on the holder 130 into contact with the inclined wall 151, and the air channel 160 will be sealed up to stop discharging air from the balloon 190 when the seal coil 120 comes into sealing contact with the inclined wall 151.

At this time, the holder 130 is sliding outwards under the pressure and is displaced to such a position that the metal spring coil 170 gets held by the button batteries 140, gets compressed and comes into contact with both the button batteries 140 and the contact piece 112, thereby connecting the circuit and illuminating the LED lamp 110.

The inflated balloon 190 is able to be deflated by pressing the top protrusion 181 inwards; when the pressure difference between inside and outside the balloon 190 is reduced to zero, the spring coil 170 gets restored freely and releases the button batteries 140 and the holder 130; and once the spring coil 170 is no longer in contact with the button batteries 140 and the contact piece 112, the circuit is disconnected and the LED lamp 110 is turned off.

In this embodiment, the lighting device is placed inside the balloon nozzle 192 and is fixed by the O-ring 191, whereas the outer end of the balloon nozzle 192 still has a structure of a flexible balloon wall. The balloon is able to be inflated in conventional ways, like by blowing with mouth, or using tools. After the balloon gets inflated, the nozzle 192 is able to be tied with a string or wound into a knot itself to achieve air tightness, and then the balloon is able to be hung up, stuck to a wall with an adhesive, or attached to a rod for use and entertainment.

Figure 7:
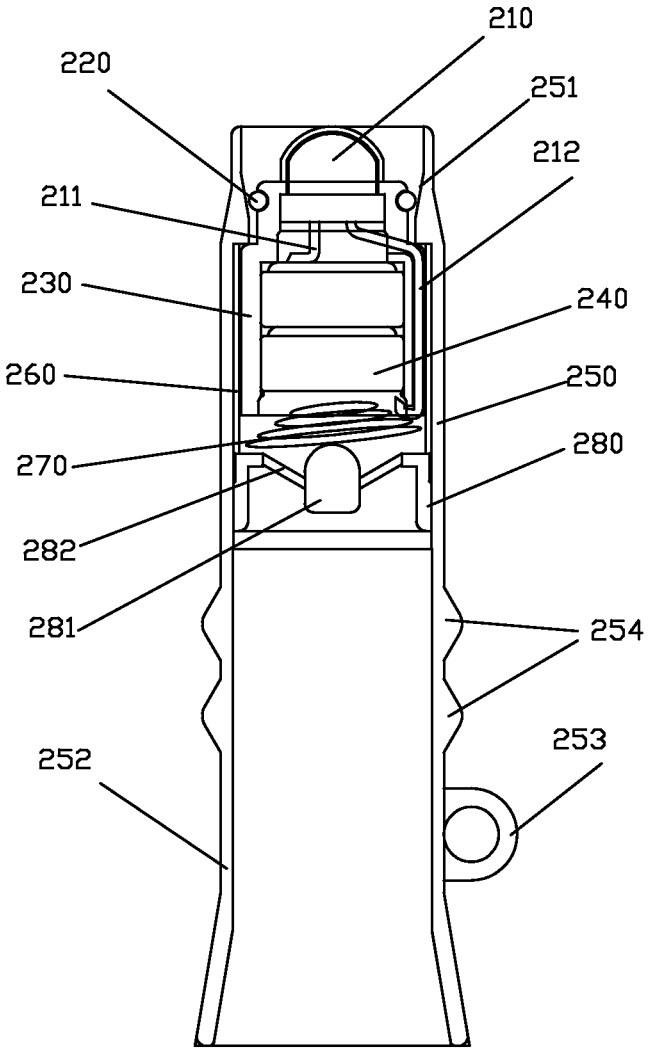
FIG. 7 is a diagram of the third embodiment of the presented invention.
Figure 8:
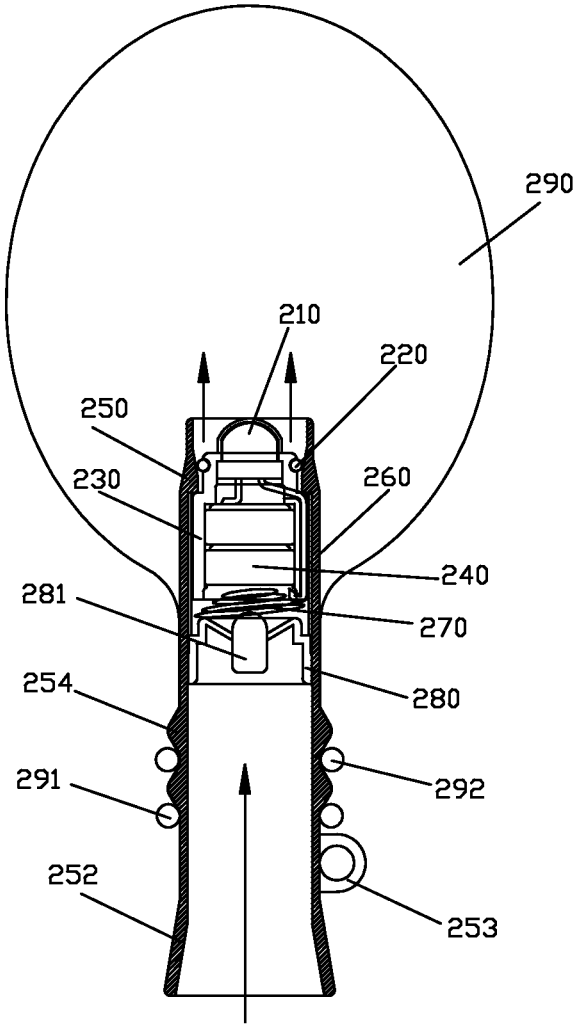
FIG. 8 is a diagram of the third embodiment during inflation.
Figure 9:
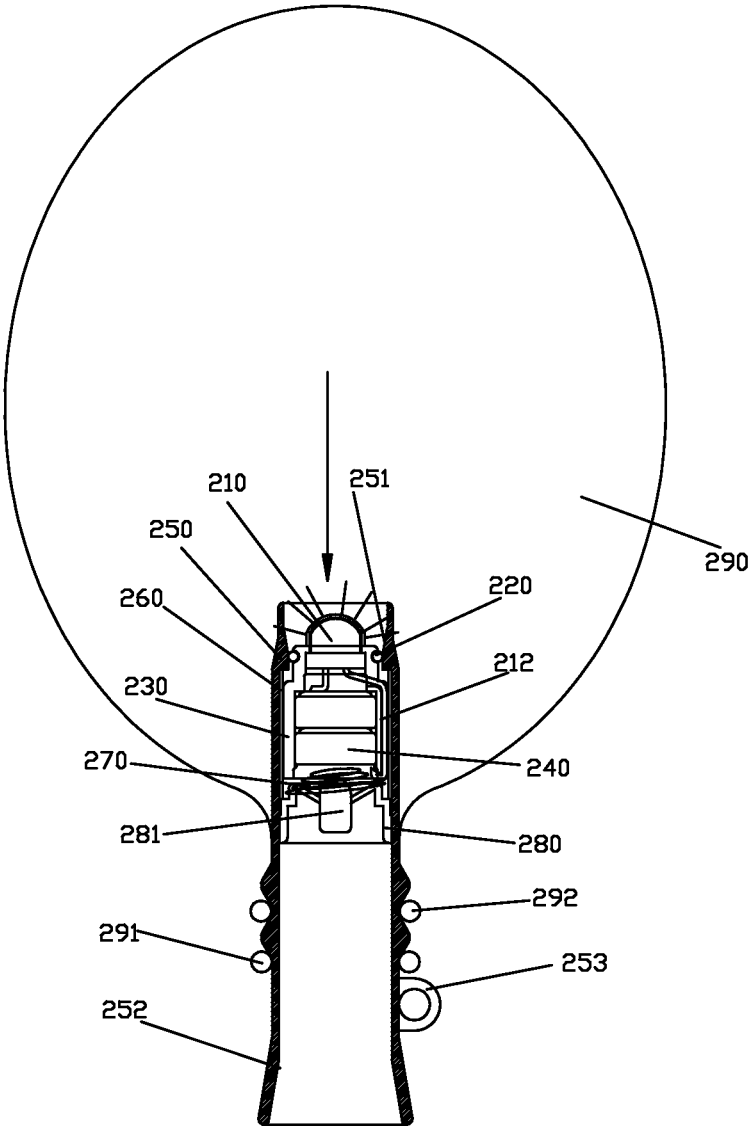
FIG. 9 is a diagram of the inflated third embodiment with an illuminated lighting lamp.

FIGS. 7~9 show the third embodiment of the present invention, which, as shown in FIG. 7, is a lighting device and mainly comprises an LED lamp 210, a holder 230, button batteries 240 and a housing 250.

Likewise, two contact pieces extend from a back end of the LED lamp 210, wherein a first contact piece 211 is directly connected between the LED lamp 210 and the button batteries 240, and a second contact piece 212 bends outwards and extends along the outer wall of the holder 230 to the back of the button batteries 240.

The button batteries 240 normally number 1 to 4 (the drawings show two batteries in a way not limiting the number thereof in other implementations), which are provided along with the LED lamp 210 inside the holder 230 and are fixedly supported by the holder 230. The holder 230 is sleeved with the hollow housing 250 with an inlet at one end and an outlet at the other end, and a clearance between the housing 250 and the holder 230 constitutes an air channel 260. An inwardly inclined wall 251 is provided at an inner side of the outlet while a ring-shaped seal coil 220 is fixed onto an outer wall of the holder 230, and the seal coil 220 projects from the outer wall of the holder 230 and is able to be clamped onto the inclined wall 251 more and more tightly to seal the air channel 260.

This embodiment is similar to the embodiment shown in FIG. 4 in that the lighting device is usually provided at the balloon nozzle, so the housing 250 firstly has an extending portion 252 with two projections 254 at the back end and an outer end convenient for handhold. The extending portion 252 further has a projecting ring 253 to attach a string so that the balloon is able to be dragged or tied on other articles.

A metal spring coil 270 is provided within the air channel 260 for connecting the contact piece 212 and the button batteries 240 to close a circuit. The metal spring coil 270 has a top ring 280 at an outer end, which is fixed on an inner wall of the housing 250. The ring-shaped top ring 280 has a top protrusion 281 projecting from a center, which is fixed to the top ring 280 via a side wall 282.

The top protrusion 281 is mainly used to hold the metal spring coil 270, but another function thereof lies in that by pressing the top protrusion 281, the button batteries 240 and the holder 230 are held and pushed into the balloon so as to deflate the balloon.

With reference to FIGS. 8 and 9, when the balloon 290 is integrated with the lighting device of the present invention, the two are able to be tightly fixed together by sleeving the projections 254 with the balloon nozzle 291 and providing a seal ring 292 between the two projections 254.

As shown in FIG. 8, air enters the balloon 290 in a direction of an arrow when the balloon 290 is inflated. At a beginning of inflation, the pressure inside the balloon 290 is very low and the pressure difference between inside and outside the balloon is negligible, but when the inner pressure reaches a certain level, the pressure difference is large enough to discharge air from the balloon through the air channel 260 so as to maintain pressure balance.

As shown in FIG. 9, during discharge of the air, the exhaust air pushes the holder 230 provided within the air channel 260 to slide outwards along the air channel 260 bringing the seal coil 220 on the holder 230 into contact with the inclined wall 251, and the air channel 260 will be sealed up to stop discharging air from the balloon 290 when the seal coil 220 comes into sealing contact with the inclined wall 251.

At this time, the holder 230 is sliding outwards under the pressure and is displaced to such a position that the metal spring coil 270 gets held by the button batteries 240, gets compressed and comes into contact with both the button batteries 240 and the contact piece 212, thereby connecting the circuit and illuminating the LED lamp 210.

The inflated balloon 290 is able to be deflated by pressing the top protrusion 281 inwards; when the pressure difference between inside and outside the balloon 290 is reduced to zero, the spring coil 270 gets restored freely and releases the button batteries 240 and the holder 230; and once the spring coil 270 is no longer in contact with the button batteries 240 and the contact piece 212, the circuit is disconnected and the LED lamp 210 is turned off.

The foregoing is only a description of the present invention in combination with preferred embodiments, and the modes for implementation of the present invention are not limited thereby in any way. Any simple derivation or replacement that may be made by those of ordinary skill in the art without departing from the spirit of the invention is covered under the protection scope claimed therein.

What is claimed is:

1. A lighting/sounding device activated by inflation of a balloon, wherein the lighting/sounding device is provided inside a balloon and is fixed onto an inner wall of the balloon by an external cover with an exhaust port connected to an outlet end of the lighting/sounding device to form an air channel; and, a piercing device is provided where the lighting/sounding device contacts the inner wall of the balloon within the external cover, and has a pointed tip to pierce the inner wall of the balloon when the external cover is fixed onto the lighting/sounding device to form the air channel.

* * * * *